United States Patent [19]

Coraccio

[11] Patent Number: 5,052,653

[45] Date of Patent: Oct. 1, 1991

[54] AUTOMATIC SWITCHING MECHANISM FOR A MODEL PLANE STARTER MOTOR

[76] Inventor: Guy J. Coraccio, 65 Gilbert St., Waltham, Mass. 02154

[21] Appl. No.: 557,134

[22] Filed: Jul. 23, 1990

[51] Int. Cl.[5] ..... F16M 13/00

[52] U.S. Cl. ..... 248/674; 248/655; 248/639

[58] Field of Search ..... 248/674, 639, 291, 655; 244/190

[56] References Cited

U.S. PATENT DOCUMENTS 2,858,386 10/1958 Bonner ..... 244/190 X 4,271,545 6/1981 Christian ..... 248/674 X

*Primary Examiner*—Alvin C. Chin-Shue

*Attorney, Agent, or Firm*—Iandiorio & Dingman

[57] ABSTRACT

An automatic switching mechanism for a model plane starter motor having a clutch bushing for gripping the propeller spinner of the plane includes a base member, a movable member movably mounted to the base member, means for mounting a starter motor to the movable member; means for biasing the movable member to a first position; and switch means for closing the electrical power circuit through the starter motor as the movable member approaches a second position responsive to the engagement of the airplane propeller spinner with the starter motor clutch bushing.

6 Claims, 3 Drawing Sheets

AUTOMATIC SWITCHING MECHANISM FOR A MODEL PLANE STARTER MOTOR

FIELD OF INVENTION

This invention relates to an automatic switching mechanism for a model plane starter motor, and more particularly to such a mechanism actuated by engagement with the propeller spinner.

BACKGROUND OF INVENTION

Radio controlled model airplanes are normally started with a hand-held motor with a driver rubber bushing on the end of the shaft. Holding onto the plane with one hand, the rubber bushing or cup is pressed with the other hand against the propeller spinner, thereby turning over the engine to start it.

In this process, the person's face is directly over the propeller, which is made from wood or plastic. If breakage should occur, the operator would be in great danger of injury. Further, when the engine starts, adjustment of the throttle valve is done by reaching around the moving propeller, placing the arm at some risk. Also, glow-plug engines need to have a battery to supply the voltage to the glow plug. Here again, the operator must reach around the moving propeller to remove the battery after starting. These propellers spin at speeds of 8,000 to 25,000 RPM. The engine's power is from a fraction of a horsepower to 3 Hp and higher. The starting of the engine procedure can be a high-risk injury situation.

SUMMARY OF INVENTION

It is therefore an object of this invention to provide an automatic switching mechanism for a model plane starter motor.

It is a further object of this invention to provide such an automatic switching mechanism which is safer, simpler, and easier to use.

It is a further object of this invention to provide such an automatic switching mechanism which enables the propeller spinner and starter motor bushing to be engaged with both hands on the airplane.

It is a further object of this invention to provide such an automatic switching mechanism which enables the propeller spinner and starter motor bushing to be engaged without having a hand on each.

It is a further object of this invention to provide such an automatic switching mechanism which enables the propeller spinner and starter motor bushing to be engaged without the need to reach across the propeller to access the needle valve, glow plug, jumper or any other part of the engine.

It is a further object of this invention to provide such an automatic switching mechanism which enables the propeller spinner and starter motor bushing to be engaged by an operator who is wholly behind or alongside of the plane.

It is a further object of this invention to provide such an automatic switching mechanism which is attachable to conventional field boxes.

This invention results from the realization that a truly safe and effective automatic switching mechanism for controlling a model airplane starter motor can be achieved by mounting the starter motor on a movable support so that even a slight movement of the motor occurring from engagement of the airplane propeller spinner with the starter motor bushing is sufficient to actuate the switch and energize the starter motor.

This invention features an automatic switching mechanism for a model plane starter motor having a clutch bushing for gripping the propeller spinner of the plane. The mechanism includes a base member and a movable member movably mounted to the base member. There are means for mounting a starter motor to the movable member and means for biasing the movable member to a first position. Switch means close the electrical power circuit to the starter motor as the movable member approaches a second position responsive to the engagement of the airplane propeller spinner with the starter motor clutch bushing.

In preferred embodiments the base may include means for mounting it to a support and the means for biasing may include a spring. The switch means may be mounted to the base member and the switch contacts may be normally open. The movable member may be pivotably mounted to the base.

DISCLOSURE OF PREFERRED EMBODIMENT

Other objects, features and advantages will occur to those skilled in the art from the following description of a preferred embodiment and the accompanying drawings, in which.

The automatic switching mechanism of this invention may be accomplished using a base member and a movable member which is movably mounted to the base member. The movable member may be movable with translational motion, such as in a sliding fashion, or rotational motion, such as a pivoting motion. There are means for mounting a starter motor to the movable member and means for biasing the movable member to a first position. There are switch means which are normally open in response to the movable member being in the first position. The switch means are closed to provide power to the starter motor when the movable member is moved to a second position against the urging of a spring in response to the engagement of the airplane propeller spinner with the starter motor of the clutch bushing. The switching means may be mounted on the base plate and actuated by the movable member, or the switching means may be mounted on the movable member and operated by engagement with an actuator on the base member. The switch may be mounted with respect to the movable member so that the switch is held open by the movable member and changes to the closed position when the movable member is driven away by the engagement of the propeller spinner with the starter motor clutch bushing. Or, the switch may be normally open and only closed when the movable member is driven to actuate the switch. The base may include simply a plate with holes or fasteners to mount it to a support such as a field box. The biasing means may include simply a spring.

Figure 1:
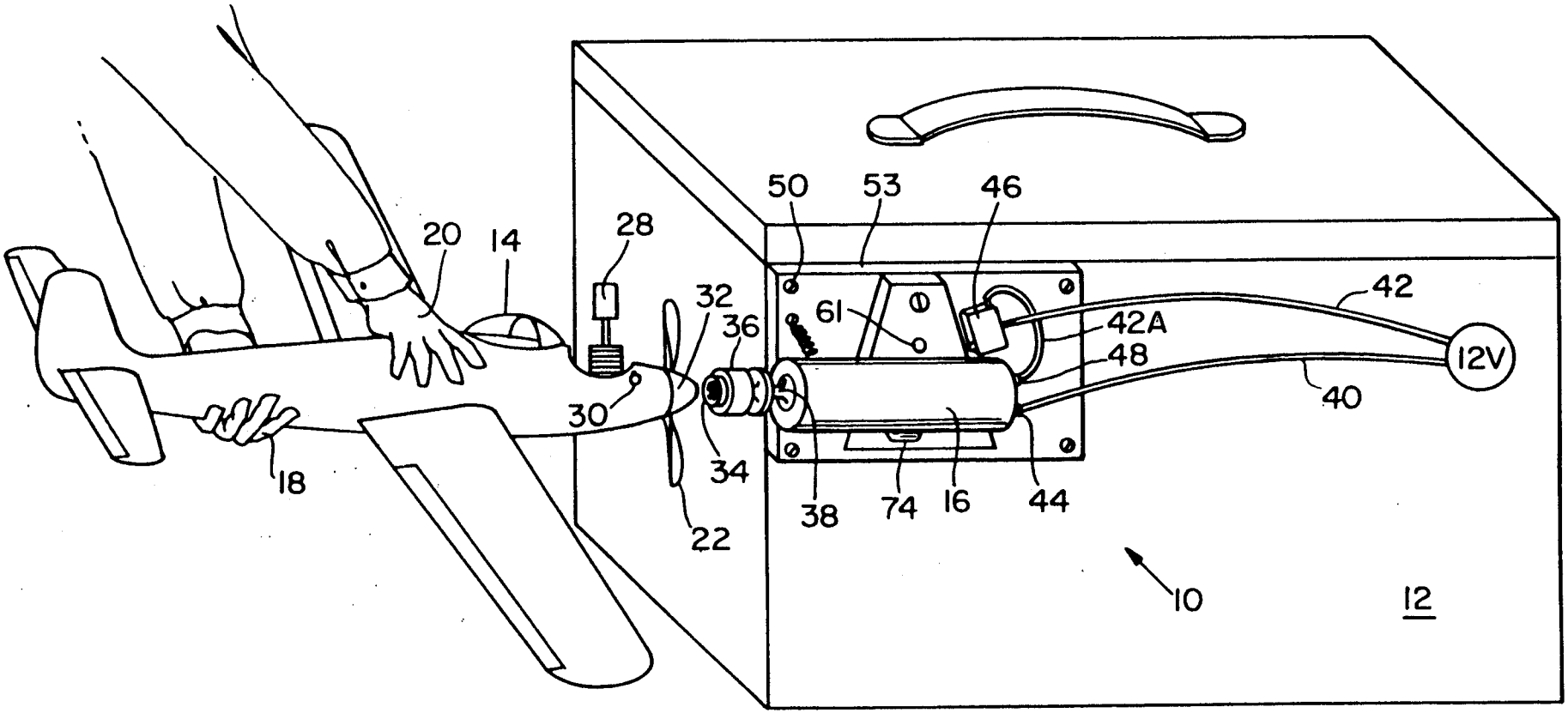
FIG. 1 is a three-dimensional view of the automatic switching mechanism of this invention mounted on a model airplane field box with the starter motor in position and a model airplane about to engage the clutch bushing of the starter motor.

There is shown in FIG. 1 an automatic switching mechanism 10 according to this invention mounted on a conventional field box 12 with a model airplane 14 about to engage with starter motor 16. Note that both hands 18 and 20 of the model airplane operator are gripping the airplane behind propeller 22, where easy access is available to disconnect the glow plug battery 28, and to the fuel adjustment needle valve 30 without reaching across propeller 22. The propeller spinner 32 in FIG. 1 is about to be engaged with the rubber clutch bushing 34 fixed to metal cup 36 on rotating shaft 38 of starter motor 16. Starter motor 16 receives its power from a battery inside field box 12 over wires 40 and 42. Wire 40 connects directly to terminal 44 on starter motor 16. Wire 42 passes through switch 46 on switching mechanism 10 and the other side of switch 46 is connected by a line 42*a* to the other terminal 48 of starter motor 16. Switching mechanism 10 is fastened with four screws 50 through holes 52 in base plate 53 to field box 12. Switch 46 is fastened to base plate 53 by screws 89.

Figure 2:
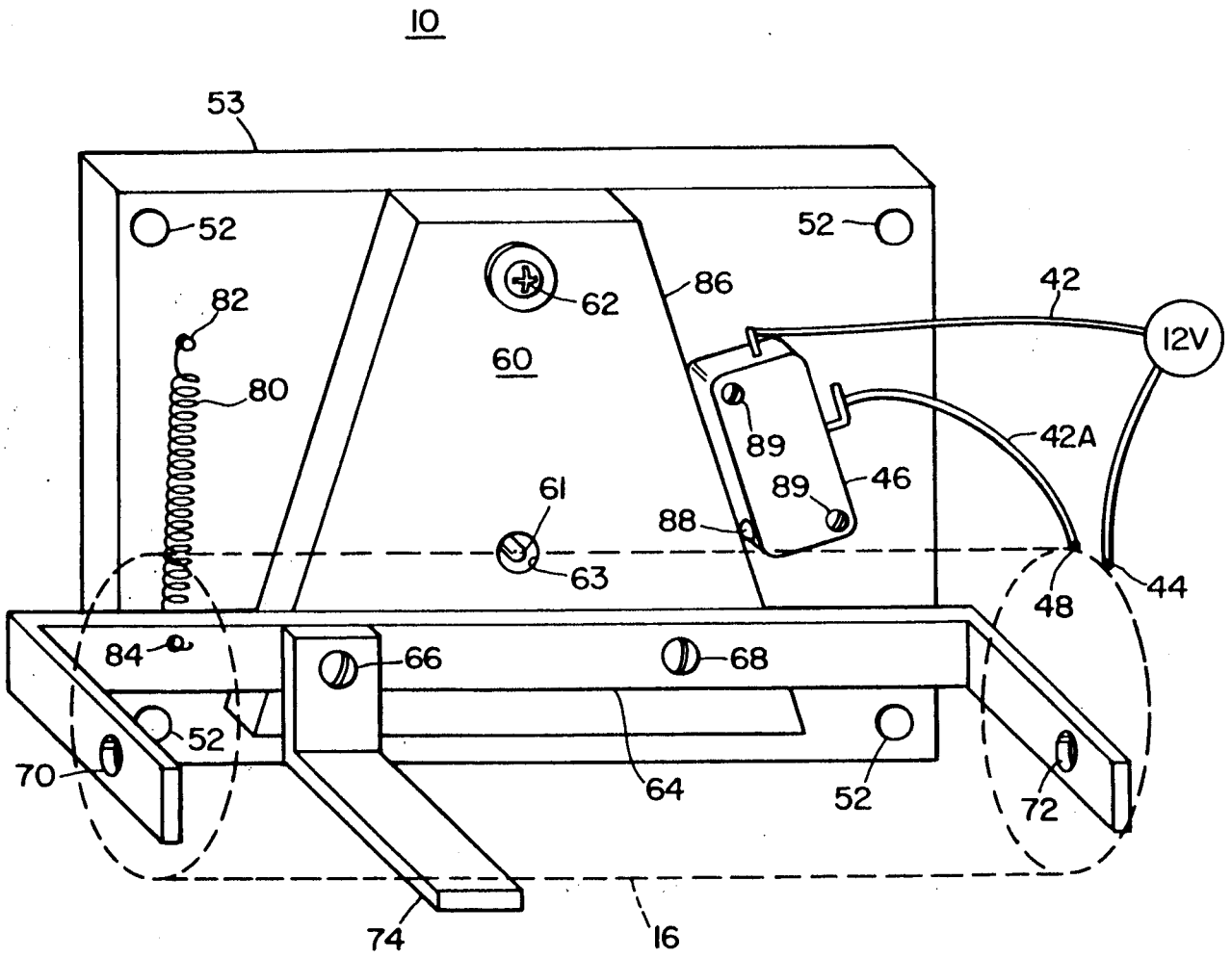
FIG. 2 is an enlarged view of the automatic switching mechanism of FIG. 1, apart from the field box with the starter motor indicated only generally in phantom.

Switching mechanism 10 includes a movable member such as pivot member 60, FIG. 2, which is pivotably mounted at pivot 62 to base member 53. A support frame 64 mounted to pivot plate 60 by means of screws 66 and 68 carries starter motor 16, which is fastened to frame 64 by screws which engage in holes 70, 72 at either end of frame 64 and a support arm 74 which curls under motor 16. A biasing device such as spring 80 is attached to a lug 82 on base plate 53 and a lug 84 on frame 64. Spring 80 biases pivot plate 60 to a first position as shown in FIG. 2. When the propeller spinner 32 is engaged with the clutch bushing 34, FIG. 1, pivot plate 60 is driven to the right against the force of spring 80 so that the rearward edge 86 of plate 60 engages actuator 88 of microswitch 46. This closes the circuit between lines 42 and 42*a*, thereby closing the power circuit of the battery through starter motor 16 so that the starter motor starts to rotate and in turn rotates spinner 32 of model airplane 14. Pin 61 fixed to base plate 53 and extending through bore 63 in pivot plate 60 acts as a stop against the sides of much larger bore 63 to limit action of the plate 60 and protect switch 46 from damage.

Figure 3:
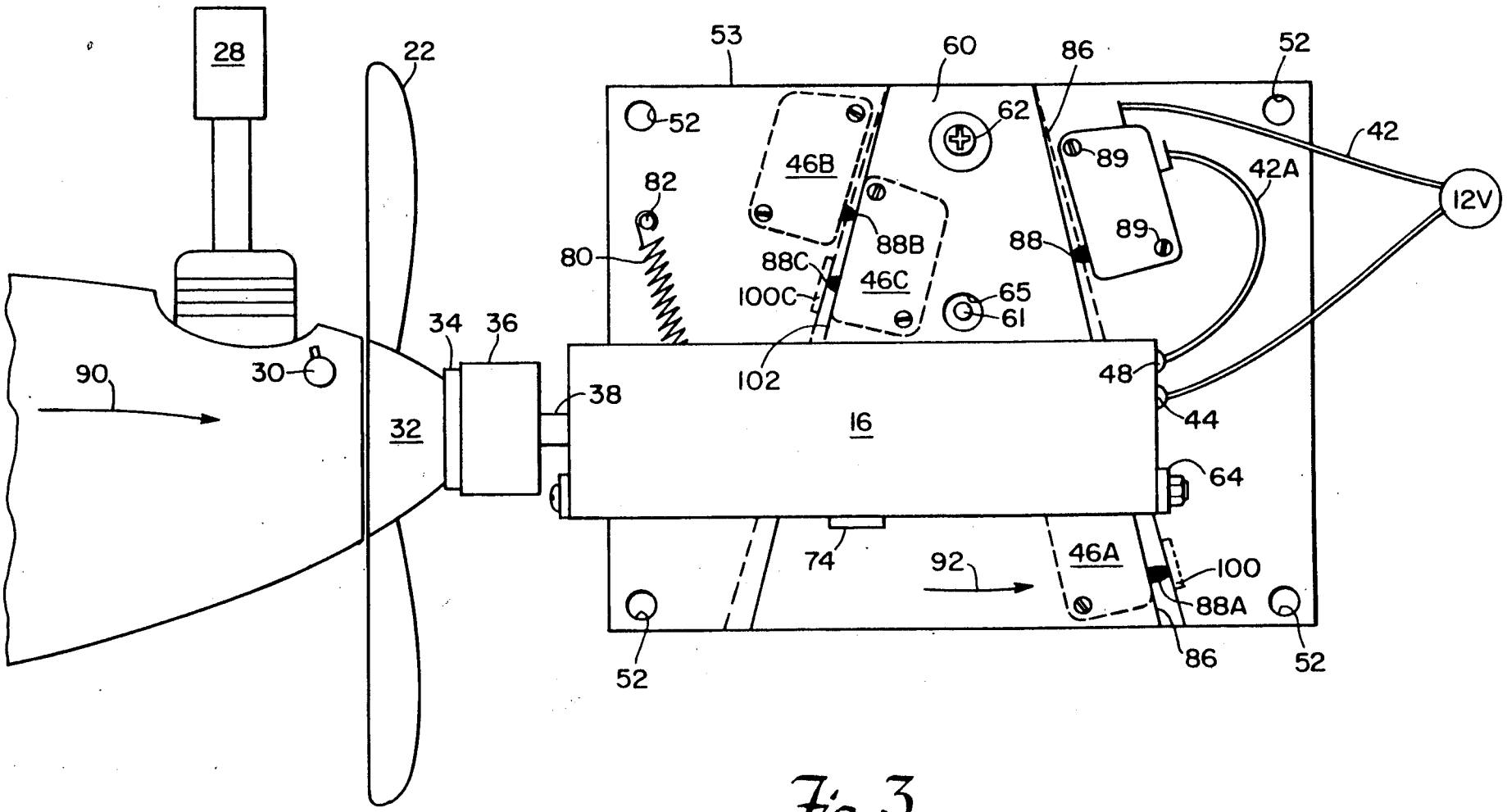
FIG. 3 is a diagrammatic elevational view of the switching mechanism of FIGS. 1 and 2 illustrating the switching action as the propeller spinner engages the starter motor clutch bearing.

In operation, when propeller spinner 32, FIG. 3, is brought into engagement with clutch bushing 34 the force 90 causes starter motor 16 and pivot plate 60 to pivot in an arc backwardly, about pivot 62, as indicated by arrow 92. This moves pivot plate 60 to the right, FIG. 3, so that its rearward edge 86 contacts actuator 88 of microswitch 46 and closes the contacts of that switch to thereby close the power circuit to starter motor 16. Although switch 46 is shown mounted on base plate 53, this is not a necessary limitation of the invention. Switch 46 could be mounted as shown at 46*a* in FIG. 3, on pivot plate 60, so that it moves with pivot plate 60 and hits the striker plate 100. Or, switch 46 could be mounted to the left of pivot plate 60 as indicated by the position of switch 46*b* in FIG. 3, so that the switch is held normally open by the forward edge 102 of pivot plate 60. When pivot plate 60 is driven to the back by the engagement of spinner 32 with bushing 34, forward edge 102 moves away from actuator 88*b*, which causes the contacts of switch 46*b* to close so that power is provided to motor 16.

Alternatively, the switch may be mounted along the forward edge 102 of pivot plate 60 as indicated by switch 46*c*, so that it is normally held in the open position by striker plate 100*c* engaging actuator 88*c*. Then when spinner 32 is engaged with bushing 34 and pivot plate 60 is moved to the right, indicated by arrow 92, the movement of switch 46*c* away from striker plate 100*c* disengages actuator 88*c*, which has been holding switch 46*c* open, so that switch 46*c* now closes and enables power to be provided to starter motor 16.

The movable plate 60 is shown as a pivot plate in the specific embodiment, but that is not a necessary limitation of the invention, as any motion will do which will actuate an associated switch; for example translational motion such as a slide would work just as well.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. An automatic switching mechanism for selectively connecting and disconnecting an electrical power source and a model plane starter motor which motor has a clutch bushing for gripping the propeller spinner of the plane comprising:
   - a base member;
   - a movable member movably mounted to said base member;
   - means for mounting the starter motor to said movable member;
   - means for biasing said movable member to a first position; and
   - switch means for selectively connecting and disconnecting the electrical power source and the starter motor, said switch means connecting the power source to the starter motor as said movable member approaches a second position responsive to the engagement of the airplane propeller spinner with the starter motor clutch bushing.

2. The automatic switching mechanism of claim 1 in which said base includes means for mounting it to a support.

3. The automatic switching mechanism of claim 1 in which said means for biasing includes spring means.

4. The automatic switching mechanism of claim 1 in which said switch means is mounted to said base member.

5. The automatic switching mechanism of claim 1 in which said switch means contacts are normally open.

6. The automatic switching mechanism of claim 1 in which said movable member is pivotably mounted to said base.

* * * * *